United States Patent [19]

Garrity

[11] 4,281,813

[45] Aug. 4, 1981

[54] BAG HOLDER

[76] Inventor: John J. Garrity, 425 San Mateo Dr., Palm Springs, Fla. 33461

[21] Appl. No.: 85,249

[22] Filed: Oct. 16, 1979

[51] Int. Cl.[3] ..... A63B 55/04

[52] U.S. Cl. ..... 248/97; 220/19

[58] Field of Search ..... 248/95, 97, 98, 150, 248/164, 166; 150/17, 48; 232/43.2; 53/390; 141/390; 220/84, 401, 19

[56] References Cited

U.S. PATENT DOCUMENTS

| | | | |
|---|---|---|---|
| 1,003,540 | 9/1911 | Sterrett | 220/401 X |
| 1,274,800 | 8/1918 | Sketteno | 220/19 X |
| 1,691,571 | 11/1928 | Haven | 248/98 |
| 2,350,427 | 6/1944 | Tichenor | 220/19 |
| 2,456,419 | 12/1948 | Jackson et al. | 220/19X |
| 2,916,178 | 12/1959 | Arthur | 220/19 X |
| 3,191,723 | 6/1965 | Shoup | 220/19 X |

FOREIGN PATENT DOCUMENTS

| | | | |
|---|---|---|---|
| 463780 | 3/1951 | Italy | 220/19 |

*Primary Examiner*—J. Franklin Foss

*Attorney, Agent, or Firm*—Malin & Haley

[57] ABSTRACT

A lightweight bag holder made from at least one section. The section of the bag holder has a first vertical edge, second vertical edge and a bag holding edge. The bag holder has a releasable connecting means which allows the first vertical edge to be moved away from the second vertical edge to form a second mouth. The second mouth allows lateral removal of the bag from the bag holder. The size of the first mouth of the bag holder can be varied to accommodate different sized bags.

6 Claims, 9 Drawing Figures

Fig. 1.
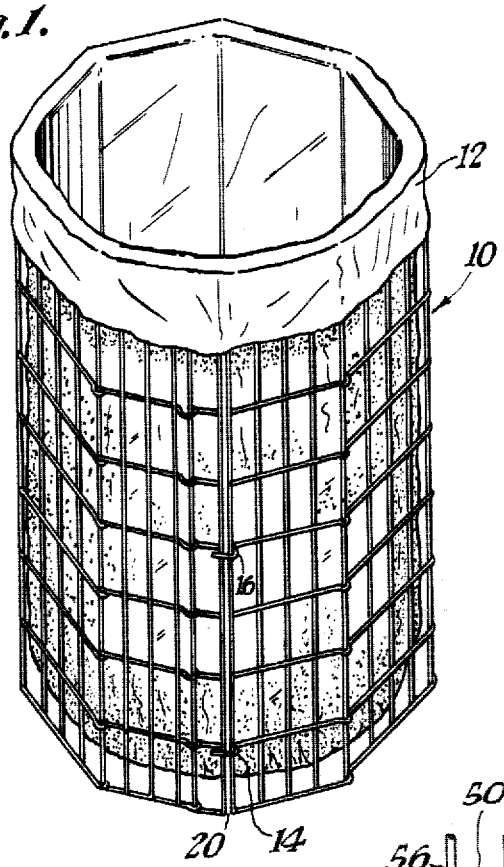
Fig. 2.
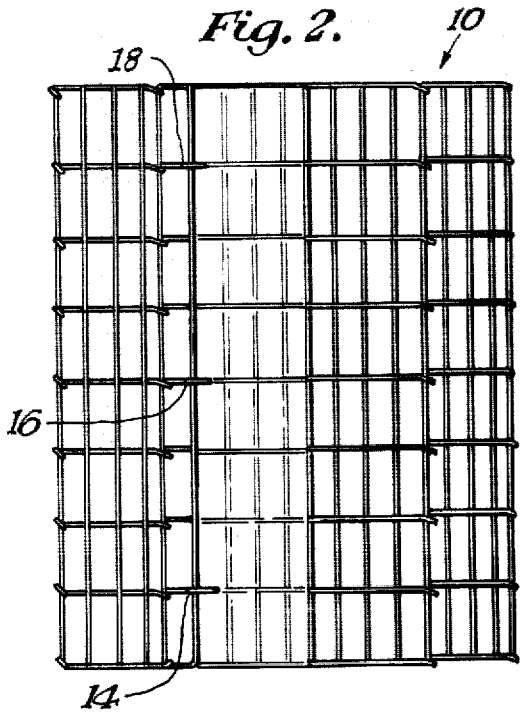
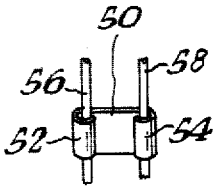
Fig. 7.
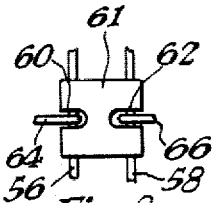
Fig. 8.
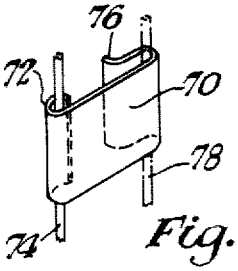
Fig. 9.
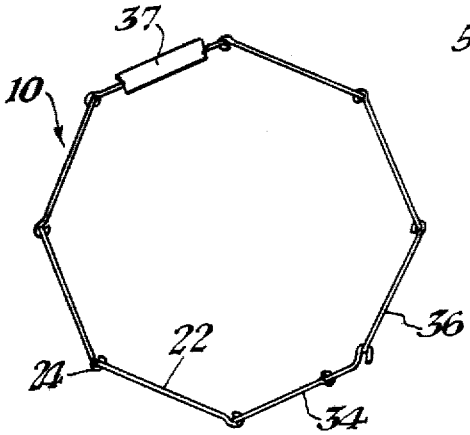
Fig. 3.
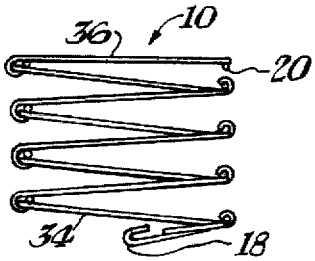
Fig. 5.
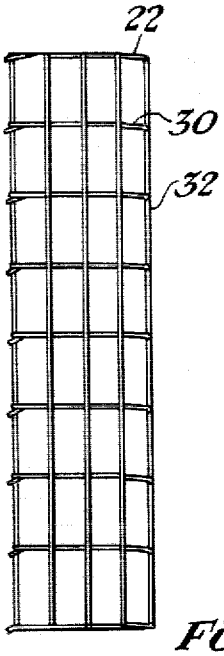
Fig. 4.
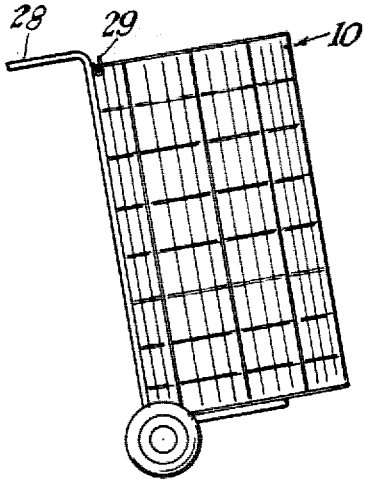
Fig. 6.

BAG HOLDER

BACKGROUND OF THE INVENTION

This invention relates to devices for holding bags, and more particularly to a lightweight bag holder in which the bag will be held with its mouth in an open distended position to quickly and easily permit the emptying of a grass catcher, lawn rakings, or other materials into the bag.

Problems with prior devices have been that the bag which is being held must be removed with the full load of the bag being lifted vertically to be removed from the bag holder; or similarly, the bag holder must be lifted vertically away from the bag if the bag holder was bottomless. The size of the receiving mouth of the prior devices have not been variable to accommodate different sized bags.

By way of example, U.S. Pat. No. 2,319,384 shows a clothes hamper. The clothes hamper is comprised of a solid cylindrical body which holds a bag for soiled clothes with the mouth of said bag being held in an open position. When the bag is full, the mouth of the bag is closed and the bag is lifted vertically from the clothes hamper.

Another embodiment illustrates a bag attached to a cylindrical meshed body where the body is removed vertically from the bag when the bag becomes full. The present invention provides a bag holder which can be spread open to allow lateral removal of the full bag from the bag holder. Thus, any bag, even if greater in length than the height of the person removing the bag, can be removed from the second mouth without the use of a ladder.

BRIEF SUMMARY OF THE INVENTION

A lightweight bag holder made from at least one section is provided. This bag holder will support a fully loaded bag to obtain maximum use of a plastic or other type of bag. The bottom of the bag is in contact with the supporting surface. The section has a first vertical edge, a second vertical edge, and a bag holding edge. The bag holder has a releasable connecting means which allows the first vertical edge to be moved away from the second vertical edge to form a second mouth. The second mouth allows lateral removal of the bag from the bag holder. The size of the first mouth of the bag holder can be varied to accommodate different sized bags.

The bag holder may be constructed of one bendable section or a plurality of interlocked sections.

The bag is attached to the bag holder simply by folding the open edge of the bag around the bag holding edge of the bag holder. When the bag becomes full, the folded edges of the bag are removed from the bag holder. The releasable connecting means of the bag holder is released and the bag holder is then spread open. In the open position, the bag holder can be pulled away from the bag along a horizontal plane, or the bag can be pulled away from the bag holder similarly along a horizontal plane, depending on whether or not the bag is in the desired location for eventual disposal.

Accordingly, it is an object of the present invention to provide an improved bag holder which can be opened on its side to allow lateral removal of a bag with the contents therein.

It is a further object of the invention to provide a bag holder whose mouth can be varied to accommodate different sized bags.

BRIEF DESCRIPTION OF THE DRAWINGS

FIG. 1 represents a perspective view of the bag holder with a bag inserted therein.

FIG. 2 represents a side view of the bag holder.

FIG. 3 represents a top elevational view of the bag holder.

FIG. 4 represents a side view of the bag holder in a folded position.

FIG. 5 represents a top elevational view of the bag holder in a partially folded position.

FIG. 6 represents a side view of the bag holder being transported by a hand truck.

FIG. 7 is an inside illustration of a clip.

FIG. 8 is an outside side view of another clip.

FIG. 9 is a perspective view of another clip used to open and close the vertical mouth.

DESCRIPTION OF THE PREFERRED EMBODIMENT

Referring more in detail to the drawings, FIG. 1 shows the bag holder 10 in its functional position with a bag 12 inserted therein and attached thereto. When the bag holder 10 is in the functional position, hooks 14, 16, and 18 or additional hooks on one end of the bag holder are interlocked with the vertical support member 20 to hold the bag holder in an open position as shown in FIGS. 1 and 2. However, the diameter of the bag holder 10 can be varied by attaching the hooks 14, 16, and 18, or additional hooks to any of the vertical members of the bag holder 10.

As can be seen in FIG. 3, the mouth of the bag holder 10 is illustrated with eight symmetrical meshed sections, like section 22, which form an octagon shape when bag holder 10 is in the functional position. The bag holder may be made with one or more sections. FIG. 4 illustrates a section comprised of a plurality of horizontal members 30 and vertical members 32 affixed to each other at their respective crossing points. Each section 22 is attached to an adjacent section by wrapping the extended portions of the horizontal members 30 around the vertical member 32 of the adjacent section. However, the sections 34 and 36, as shown in FIG. 5, are not connected in such a manner. Section 34, as shown in FIG. 5, has three hooks 14, 16, and 18 attached to the vertical member 20 on the outside edge of the section 36. The three hooks 14, 16, and 18 can be attached to a vertical support member 20 on the outside edge of section 36 when the bag holder is in the functional position. The hooks 14, 16, and 18 can be disconnected from the vertical support member 20 of the outside edge of section 36 when the bag holder is put in the folded position for storage. Also, when the bag 12, shown in FIG. 1, is full, the edges of the bag 12 which overlaps the bag holder can be removed, and the hooks 14, 16, and 18 of one end section can be disconnected from the vertical member 20 of the other end section so that the bag holder 20 can be circumferentially separated so that the bag can be removed along a horizontal plane away from the bag holder 20 without having to lift the full weight of the bag; or alternatively, the lightweight bag holder 20 can be moved away from the bag.

It should be noted that a protective edge member 37 shown in FIG. 3 may be connected around the upper edge to aid in protecting the bag.

FIG. 6 illustrates that the bag holder 10, when in the functional position, can be transported by the use of a hand truck 28. A hook 29 may be attached to the hand truck to hold a horizontal member of the bag holder 10.

It should be noted that the vertical wire members are preferred inside of the horizontal members.

The connector means shown in FIGS. 1 through 6 may be replaced by a plurality of clips, shown in FIG. 7 or 8. The clip in FIG. 7 includes a flat body 50 that has both sides 52 and 54 bent around vertical members 56 and 58 that lie along the vertical edge of two sections. The clips may have a body 61, shown in FIG. 8 with openings 60 and 62 when the clip is used at the junction of horizontal members 64 and 66. The clip body 61 is secured around vertical members 56 and 58. The clip body 61 is used to prevent relative movement of the clip on vertical members.

FIG. 9 is an illustration of a closure clip used to open or close the vertical mouth. The clip 70 is secured at 72 around a vertical edge member 74 and includes a bent portion 76 that is releasably connectable to a vertical member 78. Member 78 is a vertical edge member on the opposite side of the vertical mouth. Bent portion 76 provides a biasing effect to hold the vertical mouth closed.

This device may be constructed in small heights or larger heights on thirty-two inches or higher. The use of the vertical mouth to open the device for removal of the bag and contents provides a practical removal means. Otherwise, the bag would have to be lifted vertically, in a thirty-two inch or higher holder, to a height of sixty-four inches or more over the supporting surface to pull the bag out off of the top opening or mouth.

The bag holder is easily loaded and unloaded. The bag holder may be designed with a smooth finish to aid in protecting the bag when it is loaded and unloaded.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A bag holder for holding a bag with the mouth open and the bottom of the bag on the ground, comprising:

a body including at least five sections, each said section having a general flat shape, said sections movably connected to one another to form a cylindrical shaped body;

said body in said cylindrical shape having an upper bag holding edge;

said body having a first vertical edge and a second vertical edge, said body shaped and constructed for movement of said first vertical edge to and away from said second vertical edge to provide for transverse movement of a full bag;

said body being positioned in a cylindrical form to form a first mouth a said upper bag holding edge for receiving and holding a bag fully opened by contact along said bag holding edge of said body whereby the bag can be filled from the top without supporting the bag, and a second mouth at the bottom of said body which allows the bottom of the bag to be supported by the ground;

a releasable connecting means attached to said first vertical edge and attachable to said second vertical edge of said body, said releasable connecting means for forming and closing a transverse mouth that may be opened and closed for lateral removal of the bag without lifting the bag.

2. A bag holder as set forth in claim 1, wherein:

each said section includes a plurality of vertical and horizontal members, and a bag connectable over said upper bag holding edge.

3. A bag holder as set forth in claim 1, wherein:

said first mouth of said bag holder can be varied in size to accommodate different sized bag widths.

4. A bag holder as set forth in claim 3, wherein:

said bag holder sized to provide a height to accommodate a particular size bag lengths.

5. A bag holder as set forth in claim 4, wherein:

said height of said bag holder is equal to or greater than thirty-two inches.

6. A bag holder as set forth in claim 2, wherein:

said plurality of interconnected sections are shaped and sized to collapse said bag holder for storage.

* * * * *